US005507506A

United States Patent [19]

Shadroui

[11] Patent Number: 5,507,506

[45] Date of Patent: Apr. 16, 1996

[54] ROLLER BOOT

[76] Inventor: Geoffrey Shadroui, P.O. Box 1250, Burre, Vt. 05641

[21] Appl. No.: 151,924

[22] Filed: Nov. 15, 1993

[51] Int. Cl.[6] ..... A63C 17/04

[52] U.S. Cl. ..... 280/11.22; 280/11.27

[58] Field of Search ..... 280/11.22, 11.23, 280/11.27, 11.28, 11.19, 87.041, 87.042

[56] References Cited

U.S. PATENT DOCUMENTS

| | | | |
|---|---|---|---|
| 4,923,675 | 6/1990 | Olson et al. | 280/11.27 |
| 5,199,726 | 4/1993 | Willett | 280/11.27 |
| 5,277,437 | 1/1994 | Moats | 280/11.27 |
| 5,314,199 | 5/1994 | Olson et al. | 280/11.27 |

*Primary Examiner*—Richard M. Camby

[57] ABSTRACT

This disclosure describes the Roller Boot quick release/attach mechanism. This mechanism is applied to existing in line roller skate designs to allow the wheels to be quickly and easily removed from the boot portion of the in line skate without need for the skater to lace/unlace or strap/unstrap the skate boot. Further, the mechanism allows the skater to walk when necessary or desired without need of a separate pair of shoes.

The roller boot consists primarily of two parts, the boot and the wheel frame. The boot contains a durable sole for walking and attachment apparatus built into the boot sole and heel to allow attachment of the wheel frame.

The wheel frame provides mounting of the wheels and contains slide rails and a lock/release lever to provide attachment and locking of the wheel frame to the boot.

Normal use and operation of the Roller Boot is as follows: the skater would be wearing the boot, the wheel frame is attached to the boot by sliding the slide rails of the wheel frame into the slide channels built into the boot sole and heel. When the lock/release lever has snapped into place the wheel frame is locked to the boot. To remove the wheel frame, the skater would depress the lock/release lever and pull the wheel frame rearwards until the frame is clear of the boot.

This mechanism is designed so the skater can attach and release the wheel frame from the boot very quickly and without sitting down if desired.

2 Claims, 3 Drawing Sheets

ROLLER BOOT

INVENTION SUMMARY

This invention is a modification to existing in line roller skate designs. The modification enables the wheels and wheel frame to be quickly released from the boot using a single lock/release lever. The boot has been modified to contain both a durable sole which allows the wearer to walk about while wearing the skate boot and an attaching apparatus to attach the wheel frame to the boot.

This design is intended to allow the skater to quickly and easily remove the wheels and walk into a building, over a hazardous area, to another skating area, etc. without removing (unlacing) and putting back on (lacing up) the boot portion of the in line skate.

The wheel frame release is controlled by a single release lever operated by one hand allowing the wheel frame to be removed or installed in five to ten seconds without sitting down.

DRAWING DESCRIPTIONS

Drawings Legend

Figure 1:
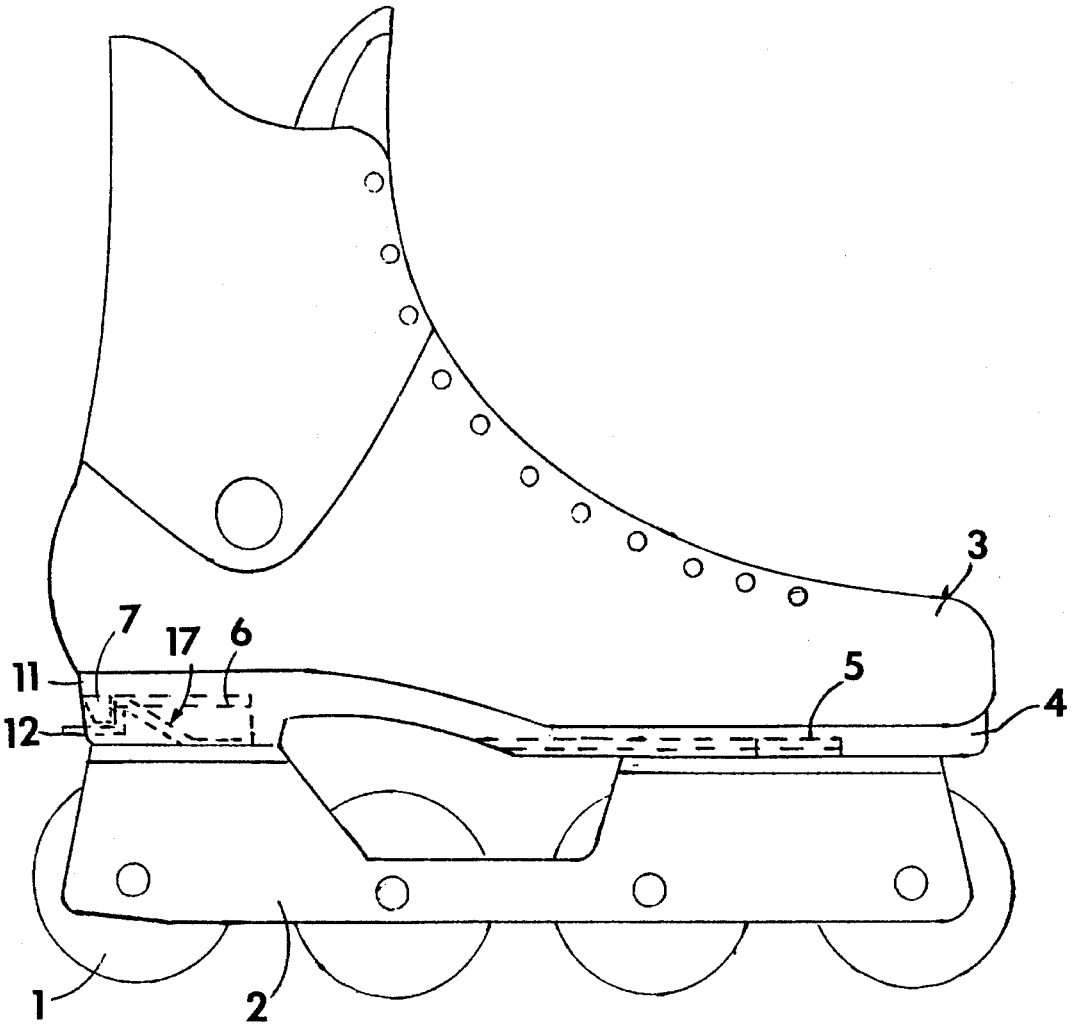
FIG. 1 shows an overall side view of the Roller Boot with the wheels (1) wheel frame (2) and boot (3).

| Item | Description |
|---|---|
| 1 | Wheels |
| 2 | Wheel Frame |
| 3 | Boot |
| 4 | Sole |
| 5 | Front Slide Channel |
| 6 | Rear Slide Channel |
| 7 | Lock/Release Cam |
| 8 | Front Slide Rails |
| 9 | Rear Slide Rails |
| 10 | Boot Bracket |
| 11 | Heel |
| 12 | Lock/Release Lever |
| 13 | Inclined Face of Lock/Release Cam |
| 14 | Locking Face of Lock/Release Cam |
| 15 | Locking Face of Lock/Release Lever |
| 16 | Side Rails |

DETAILED DESCRIPTION

This description will reference the enclosed drawings which show one method of attaching/releasing the wheel frame to and from the boot. It should be understood that other boots, shoes, clamps, latching pins, sliding rails, release levers, etc. may be substituted and are within the purview of the invention.

Referring to sheet 1, a roller boot includes a boot (3) with a rubber sole (4), two front slide rail channels (5) built within the sole, two rear slide rail channels (6) built within the boot heel (11) to which the wheel frame (2) is attached, a release lever cam (7) built into the boot heel, a wheel frame (see sheet 3) to include two front slide rails (8), two rear slide mils (9) and a lock/release lever (12) to enable the wheel frame to attach to and lock onto the boot sole.

The slide rail channels are preferably part of a metal plate embedded into the boot sole with a separate metal plates for the front and rear slide channels.

Figure 2:
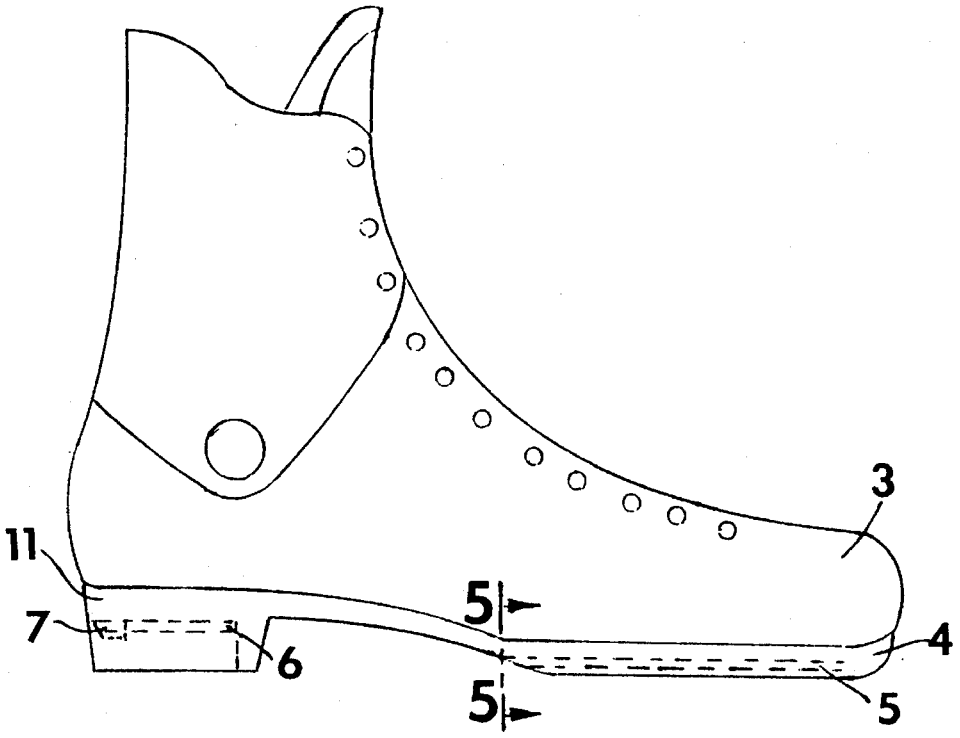
FIG. 2 shows a side view of the boot (3), the sole (4) and the front and rear slide channels (5) and (6) recessed into sole (4).
Figure 3:
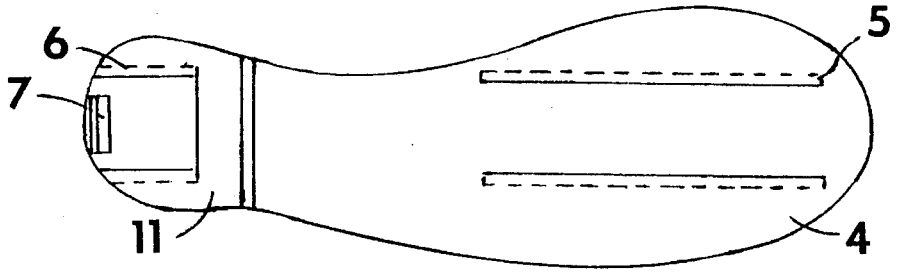
FIG. 3 shows a bottom view of the boot.
Figure 4:
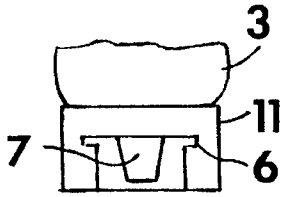
FIG. 4 is a back view of the boot.
Figure 5:
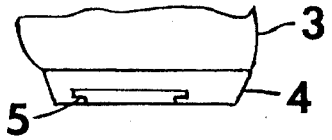
FIG. 5 is a partial front elevation of a portion of the boot, taken along the line and in the direction of the arrows 5—5 of FIG. 2, and illustrating the front slide channels.
Figure 6:
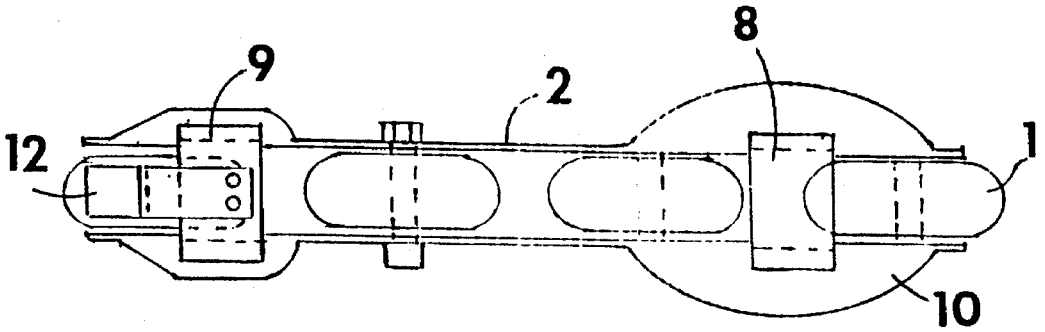
FIG. 6 is a top view of the in line skate or wheel frame.
Figure 7:
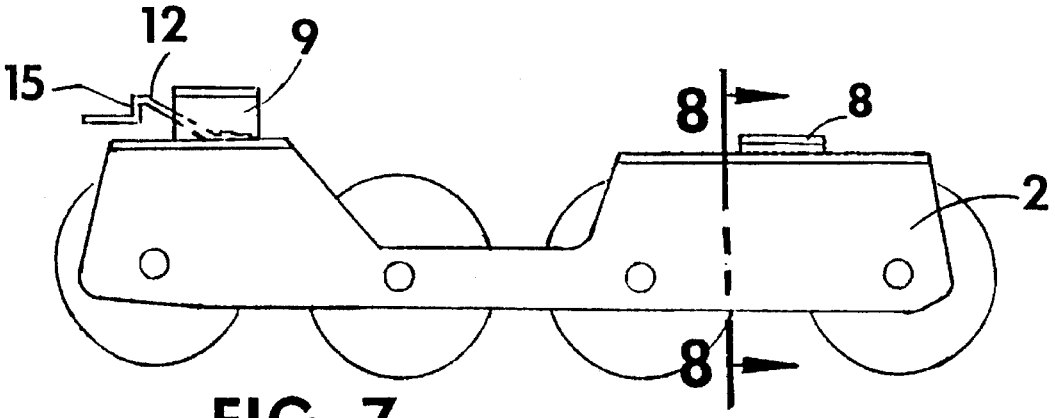
FIG. 7 is a side view of the wheel frame.
Figure 8:
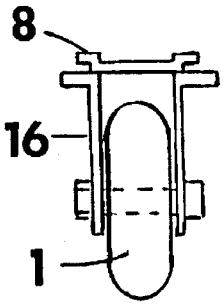
FIG. 8 is a partial front elevation of a portion of the wheel frames, taken along the line and in the direction of the arrows 8—8 of FIG. 7, and illustrating the side rails of the wheel frame and the front slide rails.
Figure 9:
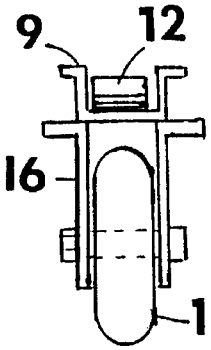
FIG. 9 is a rear view of the wheel frame.

The lock/release lever cam is part of the rear slide channels metal frame built into the heel. Operation of the lock/release lever during wheel frame installation is as follows: As the wheel frame is being slid into place, the lock/release cam (7 of FIG. 1 ) deflects the lock/release lever (12) downward an increasing amount until the lock/release lever moves beyond the cam face (13) of the lock/release cam (7) at which time the lock/release lever deflects itself upward into the locked position against the vertical face (14) of the lock/release cam (see FIG. 2). In this position the wheel frame is unable to slide rearwards and is locked into position on the boot.

When removing the wheel frame from the boot, pressing the release lever downward below the lock/release cam will allow the wheel frame to be slid rearwards. When the wheel frame is moved rearwards and beth front and rear slide rails have cleared the slide channels, the wheel frame is detached from the boot.

The lock/release lever (12) is attached to the wheel frame between the two rear slide rails. The lever is made of a flexible metal with a normal up or locked position. The boot (3) and wheel frame (2) are attached together by sliding the inclined surface (17) of the locking/release lever (12) past the lock/release cam (7) in the boot heel (11) to allow the flat locking surface (15) of the locking lever to move below the lock/release cam in the boot heel.

The front and rear slide rails are preferably constructed of the same material as the wheel frame and may be formed as a continuation of the wheel frame. The rails extend vertically above the wheel frame side rails (16) and then extend outwards on a horizontal axis a short distance. The vertical portion of the slide rails follows the same vertical plane as the wheel frame side rails.

The invention has been described with one particular type of wheel frame attaching and latching method. Other types of attaching and latching methods are available such as locking pins, latching levers, cam operated latching levers and locating and locking pins. All such variations are within the purview of the invention.

While the detailed description of the present invention has been described, it should be understood that various changes, adaptations and modifications may be made without departing from the purpose of the invention and the scope of the following claims.

I claim:

1. A roller skate boot with a in line roller skate comprising:

(a) a boot having a sole and heel, (b) a pair of front slide channels residing in said sole, (c) a pair of rear slide channels residing in said heel, (d) a wheel frame, (e) a front slide rail attached to said wheel frame and slidably engages said pair of front channels, (f) a rear slide rail attached to said wheel frame and slidably engages said pair of rear channels, (g) locking/release lever attached to said wheel frame and (h) a lock/release cam attached in said heel and bearing against an inclined surface of said locking/release lever when said wheel frame is attached to said boot.

2. The roller skate boot with a in line roller skate of claim 1 wherein said pair of front slide channels and said pair of rear slide channel are metal.

* * * * *